United States Patent [19]

Kubelka et al.

[11] 3,955,825

[45] May 11, 1976

[54] HOLDING MECHANISM FOR SKI BOOTS

[75] Inventors: Axel R. Kubelka; Gottfried Schweizer, both of Vienna; Josef Svoboda, Schwechat, all of Austria

[73] Assignee: Gertsch AG, Zug, Switzerland

[22] Filed: Mar. 24, 1975

[21] Appl. No.: 561,288

[30] Foreign Application Priority Data

Mar. 22, 1974 Austria ..... 2419/74

[52] U.S. Cl. ..... 280/618; 36/117; 280/634

[51] Int. Cl.[2] ..... A63C 9/08

[58] Field of Search ..... 280/11.35 K, 11.35 A, 280/11.35 D, 11.35 C, 11.35 M, 11.35 R, 11.26, 11.3, 11.31, 11.35 E; 36/2.5 AL

[56] References Cited

UNITED STATES PATENTS

| | | | |
|---|---|---|---|
| 1,342,773 | 6/1920 | Slawinski | 280/11.26 |
| 3,359,009 | 12/1967 | Hinterholzer | 280/11.35 K |
| 3,489,424 | 1/1970 | Gertsch et al. | 280/11.35 K |
| 3,813,109 | 5/1974 | Salomon | 280/11.35 Y |
| 3,854,740 | 12/1974 | Gertsch et al. | 280/11.35 R |
| 3,860,253 | 1/1975 | Schweizer | 280/11.35 D |
| 3,870,327 | 3/1975 | Betschart, Jr. | 280/11.35 K |

*Primary Examiner*—M. H. Wood, Jr.
*Assistant Examiner*—David M. Mitchell
*Attorney, Agent, or Firm*—Woodhams, Blanchard and Flynn

[57] ABSTRACT

A holding mechanism for holding ski boots onto a ski. The holding mechanism is comprised of a longitudinally extending rod extending parallel to the longitudinal axis of the sole of a ski boot and has at least one crossbar thereon with conventional elements for engaging and holding the boot to the crossbar. The longitudinal rod is secured at one of its ends to a holding element secured to the ski. The holding element restricts the longitudinal movement of the rod while simultaneously permitting lateral movements thereof. The longitudinal rod serves to rigidify the sole of the ski boot thereby making it possible for the ski boot to be made of a flexible material to improve the walking characteristics thereof.

14 Claims, 9 Drawing Figures

FIG. 3
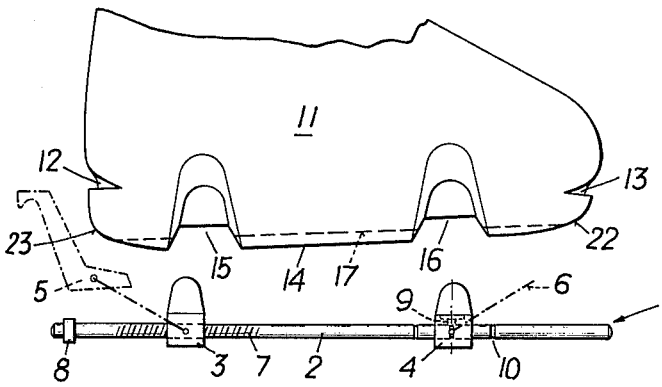
FIG. 1
FIG. 2
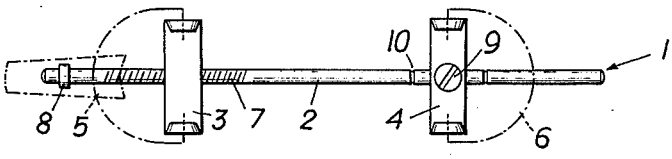
FIG. 4
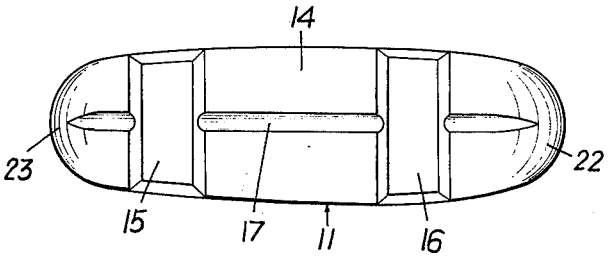
FIG. 5
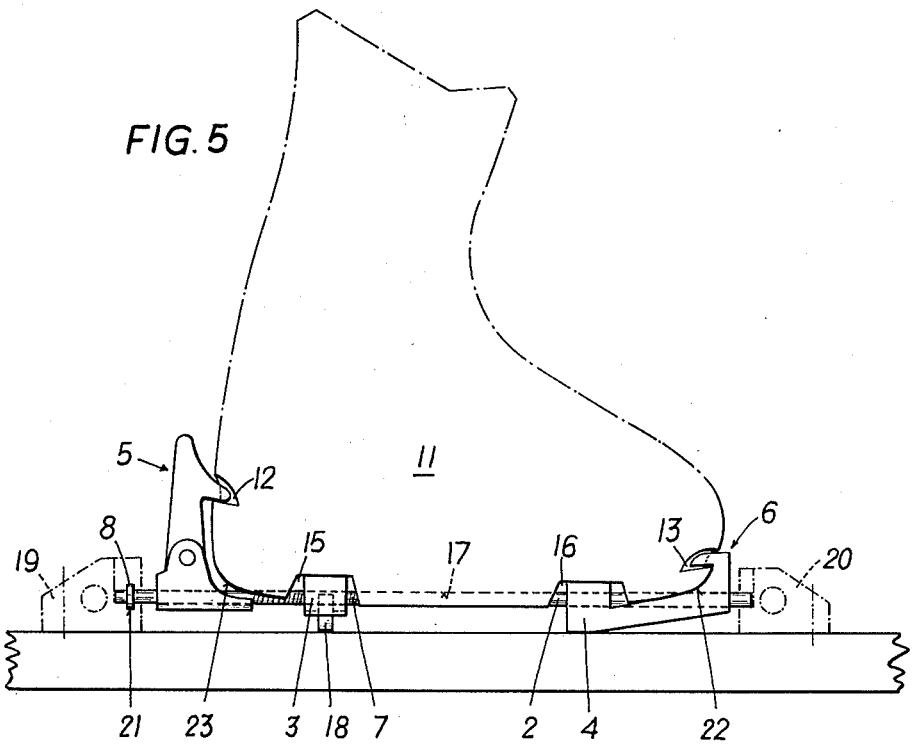

HOLDING MECHANISM FOR SKI BOOTS

FIELD OF THE INVENTION

The invention relates to a holding mechanism for ski boots having holding elements common in so-called plate bindings.

BACKGROUND OF THE INVENTION

Plate bindings having holding elements are known in many various constructions. For example, reference is made to Austrian Patent No. 271,284. In this known plate binding, holding elements are provided, which engage the front or back part of the boot and hold same in position on the ski. All the known plate bindings of this type have, however, the disadvantage, that the center point of gravity of the entire system (ski, ski binding, ski boot and skier) is increased unfavorably and that snow collects below the plate and is compressed, which makes the stepping in procedure difficult.

A purpose of the present invention is to help overcome the above-named disadvantages and to provide a quick adjustment to various sizes of boots. The purpose is achieved, according to the invention, by incorporating in the holding mechanism at least one longitudinal rod and a crossbar thereon and conventional elements for engaging and holding the boot to the crossbar. The longitudinal rod is held at at least one of its ends by a holding element permitting a release to all sides. Further, the longitudinal movement of the longitudinal rod is hindered by a locking element.

The inventive construction of the holding mechanism produces a quick adjusting possibility, since the bar or the bars or one of the two can be easily adjusted along the rod and can be held in its desired position. This device is also better suited for removal of snow than the known plates, because less snow can accumulate therein. Should snow accumulate therein, it can be easily removed from the area of the rod and the bar than in the structure of a plate.

According to a preferred embodiment of the invention, the holding mechanism is recessed at least partly in recesses of the boot sole. In this manner, the entire structural height becomes lower. Moreover, the cross profiles lend to a better walking or climbing characteristic. The holding mechanism functions as a reinforcement member for the boot sole, which permits the use of softer boot soles for normal ski boot purposes so that these boots will have more advantageous walking characteristics.

According to one thought of the invention, the one end of the longitudinal rod is held by a spring-loaded holding element, the part of which, which receives the end of the longitudinal rod, consists in cross section of two holding profiles symmetrically constructed with respect to the longitudinal axis of the longitudinally extending rod, whereby the two holding profiles correspond to the longitudinal rod profile and parts holding the recesses can be released to the side and/or upwardly against the action of the spring force. This embodiment assures that the longitudinal rod effects the release at predetermined forces corresponding with the adjusted spring force values.

According to a further characteristic of the invention, the lock has a pin, bolt, hook or the like, which cooperates with a groove, riffle, trough or the like, whereby one of the aforementioned parts is arranged on the longitudinal rod and the other one on the ski or on a part fixed to the ski. This prevents the longitudinal adjustment of the longitudinal rod, so that bending of the ski does not have any effect on the adjusted release values of the ski boot. The lock is advantageously arranged on the rear end zone of the longitudinal rod.

According to a different characteristic of the invention, the longitudinal rod has a circular cross section. Such a longitudinal rod can easily be connected with other parts of the holding mechanism.

According to a different characteristic of the invention, the longitudinal rod has a quadratic cross section. Through this construction undesired torsions in the longitudinal rod can be avoided.

A different characteristic of the invention is that at least one of the crossbars can be adjusted continuously in longitudinal direction with respect to the longitudinal rod, for example by means of a threaded spindle or in steps, for example by notches, tooth racks or the like. In this manner, an easy adjustment to variously sized boots can be made. If both bars can be adjusted lengthwise, a further advantage consists is that the overhanging length of the holding mechanism can be distributed evenly forwardly and backwardly.

According to a further characteristic of the invention, the crossbars can be supported in a conventional manner on rollers. Through this structure friction forces are absorbed.

According to a still different thought of the invention, three longitudinal rods (FIGS. 8 and 9) can be provided, which extend parallel with respect to one another and of which the central one does the engaging and disengaging. In this manner a still stronger system is obtained.

Also one inventive characteristic is in making the front and/or rear area of the sole round. In this manner, the walking characteristics of the ski boot is improved. This construction is in particular advantageous because in connection with the recesses for the crossbars the entire sole is made elastic.

BRIEF DESCRIPTION OF THE DRAWINGS

Further advantages and details of the invention will be discussed more in detail in connection with the drawings, in which:

FIGS. 1 and 2 are associated views of the inventive holding mechanism;

FIGS. 3 and 4 are a side view of a ski boot or the ski boot seen from the sole;

FIG. 5 illustrates a ski boot in the inventive holding mechanism;

FIG. 6 is a cross-sectional view taken along the line VI—VI of FIG. 7;

FIG. 7 is a cross-sectional view taken along the line VII—VII of FIG. 6;

DETAILED DESCRIPTION

Figure 7:
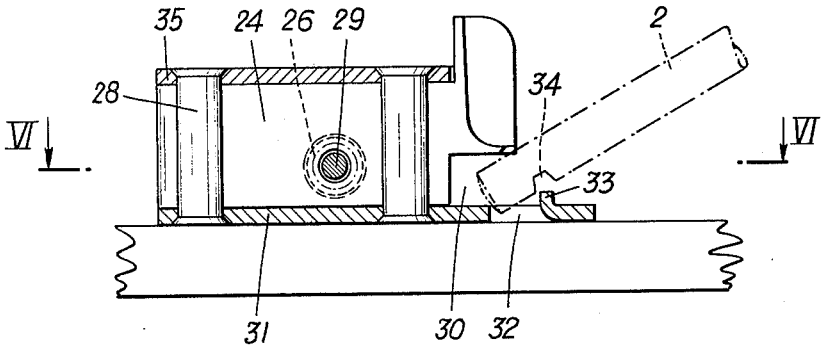
FIGS. 6 and 7 illustrate one of the holding parts for the longitudinal rod, whereby

As can be recognized from FIGS. 1 and 2, the entire holding mechanism 1 has a longitudinal rod 2 and two crossbars 3,4. The crossbars 3,4 have conventional holding elements 5 or 6 secured thereto which cooperate with counterparts 12,13 provided on a ski boot 11.

The longitudinal rod 2 has adjacent the rear end a threaded portion 7 which permits a longitudinal adjustment of the crossbar 3, which has a nut mounted thereon engaging the thread 7, relative to the longitudinal rod 2 in response to a rotation of the rod 2. A collar 8 is provided at the rear end of the longitudinal rod 2. The collar 8 rests in a groove in an element secured on the ski to hinder in the longitudinal movement of the rod 2. (The element 19 in which the groove 21 is provided on the ski is illustrative in FIG. 5.) Adjacent the front end, the cross bar 4 is illustrated as having a rotatable pin 9, which is supported for movement between longitudinally spaced notches 10 on the longitudinal rod 2. This easily permits the adjustment to various boot sizes.

As can be recognized from FIG. 3, recesses 15,16 are provided in the area of the boot sole 14 and cooperate with the crossbars 3,4. As illustrated in FIGS. 4 and 5, a longitudinally extending groove 17 is also provided in the boot sole to receive the longitudinal rod 2, so that the entire holding mechanism 1 is at least partly recessed in the boot sole. This construction has the advantage that the entire height of the holding mechanism 1 and, thus the center of gravity of the entire system, is lower. Care must be taken that the recesses 15,16 are slightly larger than the dimensions of the crossbars 3,4 to assure the existance of a certain clearance space therebetween.

FIG. 4 illustrates the bottom surface of the boot sole 14 with the holding mechanism 1 omitted. The groove 17, as stated above, is provided for receiving the longitudinal rod 2 therein, the recesses 15,16 for receiving the crossbars 3,4 therein.

FIG. 5 illustrates the holding elements 5,6 received in the counterparts 12,13 contained on the boot 11 and the recesses 15,16 receiving the crossbars 3,4. In addition, the crossbar 3 is supported on rollers 18 having an axis of rotation parallel to the longitudinal axis of the ski boot so that during a release operation, an easier cross movement of the rod 2 is permitted. Ski binding parts 19,20 mounted on the ski are only indicated in broken lines to show how the longitudinal rod 2 is being held relative to the ski. The above-mentioned groove 21 serves to receive and hold the collar 8. Since the holding elements 5,6 and the binding parts 19,20 are actually known, a further description of these parts is deemed not necessary.

As can be recognized from FIGS. 3 and 5, the front and rear surfaces 22 or 23 of the boot sole are rounded off. Thus, it is easier to walk with the ski boot. Further, the recesses 15,16 in the boot sole also increases the flexibility of the ski boot sole and, therefore, improves the walking characteristics of the ski boot.

The invention is not limited to the illustrated exemplary embodiment. A number of possibilities exist, which lie within the scope of the claims. Thus it is, for example, possible to adjust the one bar with respect to the other one by two adjusting screws, so that the one bar slides only on the longitudinal rod. In this case, the adjusting screws serve as further longitudinal rods. However, it is also conceivable to support the two crossbars on counterthreads, through which the adjustment can be carried out simply in the center and by rotating the longitudinal rod. To improve the walking characteristics of the ski boot, it is also possible to provide the ski boot with recesses at least in the front part to improve the climbing capability.

Figure 6:
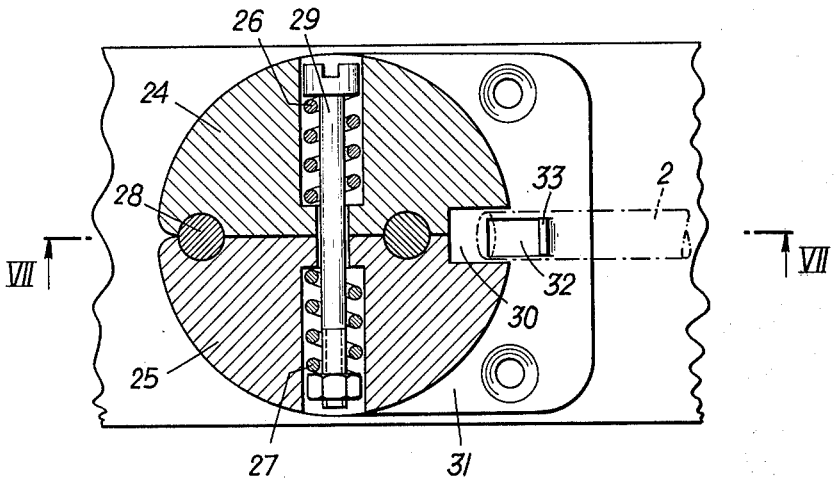
Figure 8:
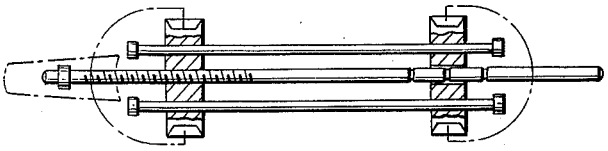
FIG. 8 is a top view of a modified embodiment.
Figure 9:
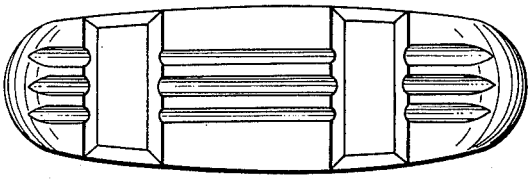
FIG. 9 is a bottom view of a modified sole for a ski boot.

Referring now to FIGS. 6 and 7, the holding part 1 is formed of two semi-cylindrical-shaped cups 24,25 which lie symmetrically with and on opposite sides of the longitudinal axis of the ski. The cups 24,25 are pivotally supported about the axis of the bolt 28 against the force of the springs 26,27 which bias the cups into engagement with each other. The springs 26 and 27 are supported on a common axis of a bolt 29 which is at a right angle to the longitudinal axis of the ski.

A recess 30 is provided in the coupled together cups 24,25 and receives an end of the longitudinal rod 2, which is illustrated in broken lines in FIG. 7 in the guiding-in condition. To make the stepping in procedure easier, the base plate 31 has an opening 32 therein. The front part of the base plate 31 is bent up and is used as a part of the lock which, in this exemplary embodiment, consists of a tab 33 on the plate 31 and a groove 34 in the longitudinal rod 2.

The recess 30 consists, in the present exemplary embodiment, of two symmetrically formed notches in each cup 24,25 and are aligned with the longitudinal axis of the longitudinal rod 2. To improve the release operation, the upwardly extending part of the cups may have various degrees and/or curve-like shapes.

The two cups 24,25 are inserted between the base plate 31 and a cover plate 35. The cover plate 35 is riveted to the base plate 31. In this manner a compact holding mechanism is formed.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a releasable ski binding including first and second longitudinally spaced binding parts mounted on a ski for releasably engaging and releasably holding a bottom member on which a ski boot is mounted to said ski, the improvement comprising wherein said bottom member comprises at least one elongated rod having a width substantially less than the width of said ski boot and has at least one crossbar thereon extending laterally outwardly of said elongated rod and has holding means thereon for engaging said ski boot to hold said ski boot in engagement with said crossbar and said elongated rod, opposite ends of said elongated rod releasably engaging said first and second binding parts to releasably hold said elongated rod to said ski, one of said first and second binding parts releasably holding one end of said elongated rod against at least a lateral movement and locking means on said elongated rod cooperable with one of said first and second binding parts for preventing a longitudinal movement of said elongated rod relative to said ski.

2. The improvement according to claim 1, wherein said ski boot has a boot sole with at least one laterally extending recess therein receiving said crossbar therein.

3. The improvement according to claim 1, wherein one of said first and second binding parts comprises a spring-loaded holding element consisting in cross section of two holding profiles which are symmetrically constructed to the longitudinal axis of said elongated rod and are resiliently connected to each other by a spring so that relative lateral movement of each is permitted against the urging of said spring, each of said two holding profiles having surfaces corresponding to the profile of said elongated rod, an end of said elongated rod being received between said profiles and releasably held therebetween and against at least a lateral movement by said spring.

4. The improvement according to claim 3, wherein said holding profiles also releasably hold said elongated rod against a vertical movement.

5. The improvement according to claim 1, wherein at least one of said elongated rod and said crossbar have adjusting means for permitting an adjustment of the position of said crossbar on said elongated rod in a longitudinal direction of said elongated rod.

6. The improvement according to claim 5, wherein said crossbar includes a roller thereon rotatable about an axis parallel to the longitudinal axis of said elongated rod and is adapted to engage the upper surface of said ski when said elongated rod is releasably coupled to said first and second binding parts.

7. The improvement according to claim 5, wherein said adjusting means comprises a threaded connection between said elongated rod and said crossbar.

8. The improvement according to claim 1, wherein said locking means includes a first member which cooperates with a second member, whereby one of the aforementioned first and second members is arranged on said elongated rod and the other of said first and second members on said one of said first and second binding parts.

9. The improvement according to claim 1, wherein said elongated rod has a circular cross section.

10. The improvement according to claim 1, wherein said elongated rod has a quadratic cross section.

11. The improvement according to claim 1, including three elongated and parallel rods, the central one of which engages said first and second binding parts.

12. The improvement according to claim 1, wherein at least one of the front and the rear end of the boot sole is rounded off.

13. The improvement according to claim 1, wherein both the front end and the rear end of the boot sole is rounded.

14. The improvement according to claim 1, wherein said elongated rod has two crossbars mounted thereon, each having holding means engaging said ski boot at spaced locations.

* * * * *